US007059888B2

(12) United States Patent
Frappier et al.

(10) Patent No.: US 7,059,888 B2
(45) Date of Patent: Jun. 13, 2006

(54) HIGH TEMPERATURE LAMP CONNECTOR AND SOCKET FOR DOUBLE-ENDED LAMP

(75) Inventors: Michael J. Frappier, Concord, NH (US); William H. Gosselin, York, ME (US); Jonathan B. Arold, Exeter, NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/930,664

(22) Filed: Aug. 31, 2004

(65) Prior Publication Data

US 2006/0046558 A1 Mar. 2, 2006

(51) Int. Cl.
*H01R 13/64* (2006.01)
*H01R 33/08* (2006.01)
*H01R 33/02* (2006.01)

(52) U.S. Cl. ..... 439/375; 439/226; 439/241

(58) Field of Classification Search ..... 439/226, 439/239, 241, 830, 831, 375
See application file for complete search history.

(56) References Cited

U.S. PATENT DOCUMENTS 6,309,236 B1 * 10/2001 Ullrich ..... 439/226
2004/0219839 A1 * 11/2004 Faust et al. ..... 439/682

FOREIGN PATENT DOCUMENTS

DE 295 04 517 3/1995
FR 938613 10/1948

OTHER PUBLICATIONS

Bender & Wirth Specification Sheet, Socket 951, Lampholder SFc10-4, Jun. 23, 2004.

* cited by examiner

*Primary Examiner*—Chandrika Prasad
(74) *Attorney, Agent, or Firm*—Robert F. Clark

(57) ABSTRACT

A socket (5) for a double-ended lamp (12) comprises a pair of opposed connectors (10) including single-piece ceramic housings (14) each having a top surface (16) and a bottom surface (18) and including a contact receiving area (20) formed in the top surface (16). An electrical contact (22) is positioned in the contact receiving area (20) and secured by any suitable means. The electrical contact (22) has a rectangular base (24) with two sides (26, 28) and two ends (30, 32). Opposed, upright walls (34, 36) extend from the sides (26, 28) of the base (24), and an upright clip (38) extends from one end of the base, for example, end (30). The upright walls (34, 36) and the upright clip (38) have portions projecting beyond the top surface (16) of the ceramic housing (14) to receive an end (40) of the lamp (12) therein. The electrical contact (22) is further mounted within a supplemental spring (50) having opposed legs (54, 56) which are adjacent to the upright walls (34, 36) of the contact. The legs (54, 56) engage the upright walls (34, 36), particularly when a lamp is inserted, providing increased tension thereto. The opposed connectors (10) are separated by a given distance and attached to a connecting bar (70).

11 Claims, 4 Drawing Sheets

HIGH TEMPERATURE LAMP CONNECTOR AND SOCKET FOR DOUBLE-ENDED LAMP

TECHNICAL FIELD

This invention relates to lamp sockets and more particularly to high-temperature lamp sockets for double-ended lamps.

BACKGROUND ART

Double-ended metal halide arc discharge lamps are known. Some kinds of these lamps have achieved wide usage in entertainment lighting. One particular version of such a lamp is designated SharXS® and is produced by Osram Photo-Optic. Lamps of this type are available from Osram Sylvania Inc., Danvers, Mass. 01923. These lamps are provided in wattages from 200 to 1200 and operate at quite high temperatures. In fact, typical operating temperatures in area of the connector are in the range of 200 to 300° C. in lamp fixtures. It is, of course, imperative that the connectors employed with these lamps also be able to operate for long periods of time at such temperatures and still maintain good electrical contact. One type of socket for double-ended lamps is shown and described in German Gebrauchmuster No. 295 04 517, filed Mar. 22, 1995. The socket comprises a pair of spaced ceramic bodies containing electrical contacts in the form of a clip with a single lateral retaining spring. However, because of the limited number of contact surfaces and the single retaining spring, poor electrical and mechanical contact with the lamp can result, particularly after multiple lamp insertions and high-temperature operation. In particular, bending or over depression of the single retaining spring will result in poor or no electrical contact or a lack of contact force.

SUMMARY OF THE INVENTION

It is, therefore, an object of the invention to obviate the disadvantages of the prior art.

It is another object of the invention to provide connectors that enhance high-temperature lamp sockets.

It is yet another object of the invention reduce the cost of high-temperature lamp sockets.

Still another object of the invention is the reduction of the complexity of such sockets.

These objects are accomplished, in one aspect of the invention, by a connector for a lamp that comprises a ceramic housing having a top surface and a bottom surface and including a contact receiving area formed in the top surface. An electrical contact is positioned in the contact receiving area, the electrical contact having a rectangular base with two sides and two ends and having opposed, upright walls extending from the sides of the base. An upright clip extends from an end of the base and the upright walls and the upright clip have portions projecting beyond the top surface of the ceramic housing to receive an end of a lamp therein. The electrical contact is mounted within a supplemental spring having opposed legs which are adjacent to the upright walls of the contact. The supplemental spring engages the upright walls when a lamp is inserted in order to maintain contact force during operation of the lamp.

In another aspect of the invention, a lamp socket is provided for a double-ended lamp wherein the lamp socket has opposed connectors as described above. The opposed connectors are separated by a given distance and attached to a connecting bar.

The contact design improves the insertion and retention forces resulting in better insertion and retention of the lamp, lower contact resistance, and lower contact temperature. The lower insertion force results in less stress on the lamp during installation. The improved retention force during lamp operation results in a longer operating life and better long-term performance after multiple lamp installations.

DETAILED DESCRIPTION OF THE INVENTION

Figures 1, 2:
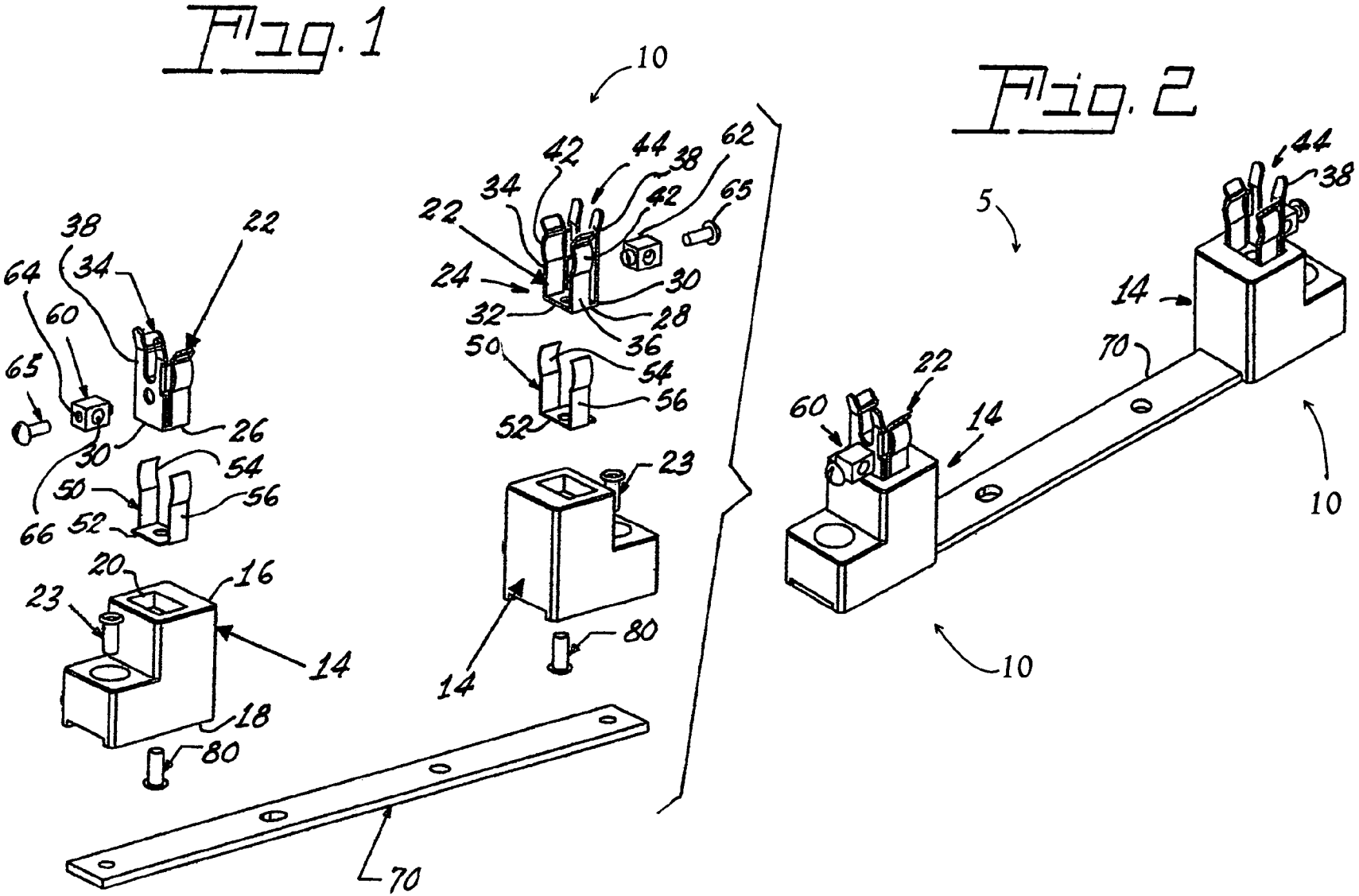
FIG. 1 is an exploded perspective view of a lamp socket and connectors in accordance with an embodiment of the invention.
FIG. 2 is a perspective of the assembled lamp socket.
Figure 3:
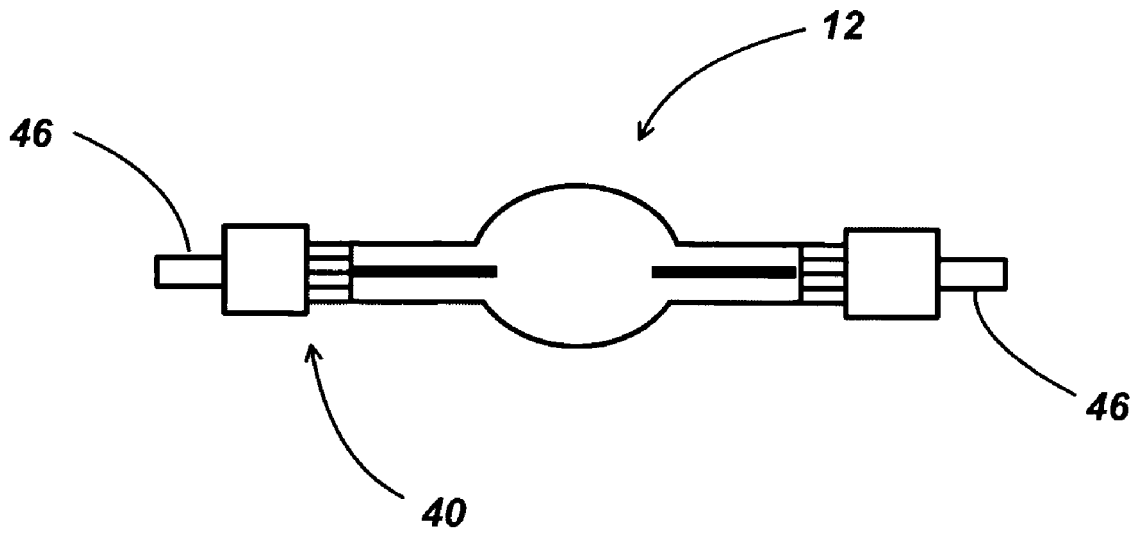
FIG. 3 is a diagrammatic elevational view of a lamp useable with the socket.

For a better understanding of the present invention, together with other and further objects, advantages and capabilities thereof, reference is made to the following disclosure and appended claims taken in conjunction with the above-described drawings.

Referring now to the drawings with greater particularity, a socket 5 for a lamp 12 comprises a pair of opposed connectors 10. The connectors 10 include single-piece ceramic housings 14 each having a top surface 16 and a bottom surface 18 and including a contact receiving area 20 formed in the top surface 16. In a preferred embodiment of the invention the ceramic is a steatite. Other useful ceramics include cordiorite, alumina, and porcelain. The one-piece ceramic housing design reduces the number of parts as well as the overall weight. An electrical contact 22 is positioned in the contact receiving area 20 and secured by any suitable means, such as eyelet 80. The electrical contact 22 has a rectangular base 24 with two sides 26, 28 and two ends 30, 32 and is preferably made from a high temperature nickel, such as 201 Nickel. It may also be desirable to provide the electrical contact with a pure nickel plating at a thickness of 2–4 microinches.

Opposed, upright walls 34, 36 extend from the sides 26, 28 of the base 24, and an upright clip 38 extends from one end of the base, for example, end 30. The upright walls 34, 36 and the upright clip 38 have portions projecting beyond the top surface 16 of the ceramic housing 14 to receive an end 40 of the lamp 12 therein.

Because the end 40 of the lamp 12 is generally cylindrical, the opposed, upright walls 34, 36 have curved terminal ends 42 to accommodate the curved surface and additionally the opposed, upright walls 34, 36 are resilient so as to frictionally engage the end 40 of the lamp 12.

The upright clip 38 has its terminal end 44 horseshoe-shaped to engage a second zone 46, typically a threaded projection, of the end 40 of the lamp 12.

To further insure good electrical and mechanical contact between the lamp and upright walls 34 and 36, the electrical contact 22 is mounted within a supplemental spring 50. The supplemental spring 50 is substantially U-shaped with a bight 52 positioned beneath the rectangular base 24 of the electrical contact 22 and with its opposed legs 54, 56 adjacent to the upright walls 34, 36. The opposed legs 54, 56 of the supplemental spring 50 engage the upright walls 34, 36 of the contact 22, particularly when a lamp is inserted, providing increased tension thereto. Preferably, the supplemental spring material should substantially retain its resiliency to at least a temperature of about 300–350° C. More preferably, the supplemental spring 50 is made from Inconel 718. The contact structure with the supplemental spring greatly enhances the retention of the lamp. Furthermore, the additional contact surfaces act to reduce the electrical resistance between the lamp and the connectors.

Figure 6:
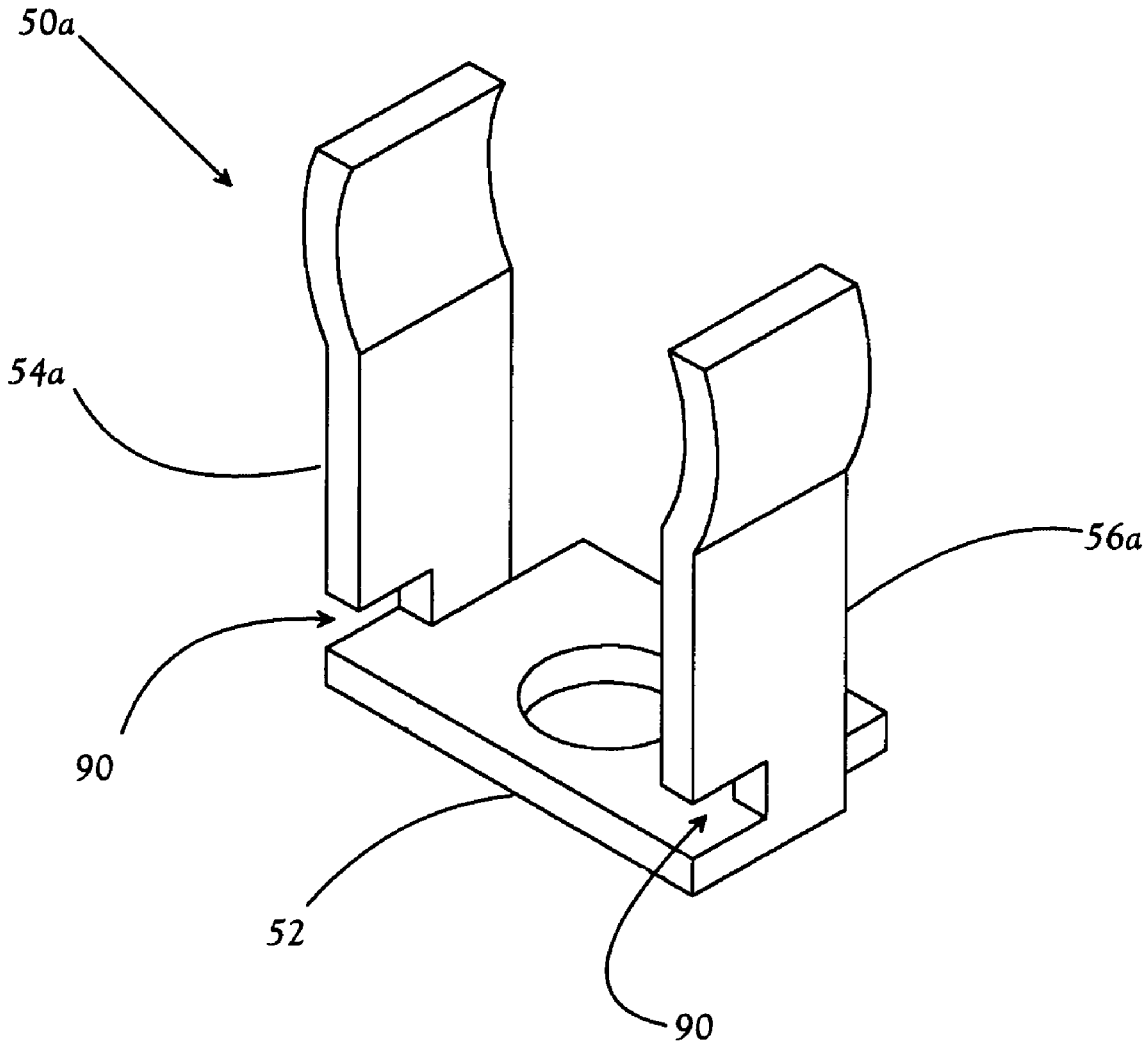
FIG. 6 is a perspective view of an alternative embodiment of the supplemental spring.

An alternative embodiment of the supplemental spring 50*a* is shown in FIG. 6. The opposed legs 54*a*, 56*a* have a notch 90 located in a region adjacent to bight 52. By adjusting the size of the notches 90 in the supplemental spring 50*a*, it is possible to change the force applied to the upright walls 34, 36 of the contact 22 without changing the spring material itself. In a preferred embodiment, the supplemental spring is made from 0.040-inch thick Inconel 718, each notch is 0.06 inches high by 0.09 inches deep, and the opposed legs are about 0.188 inches wide.

A wire connector 60 is attached to the upright clip 38 by a screw or bolt 65 and comprises a metal block 62, preferably of brass, and can be nickel plated. The block 62 has two orthogonal apertures 64, 66 therethrough; a first of the apertures, for example 64, for receiving the screw or bolt 65 to mount the wire connector 60 to the upright clip 38. The second of the apertures 66 is formed to receive a wire from a power supply. Preferably, the aperture 66 comprises a bore through the metal block 62 so that the wire from the power supply may be inserted from either side of the block.

As noted, the socket 5 comprises opposed connectors 10 that are separated by a given distance and are attached to a connecting bar 70, as by eyelets 23.

Figure 4:
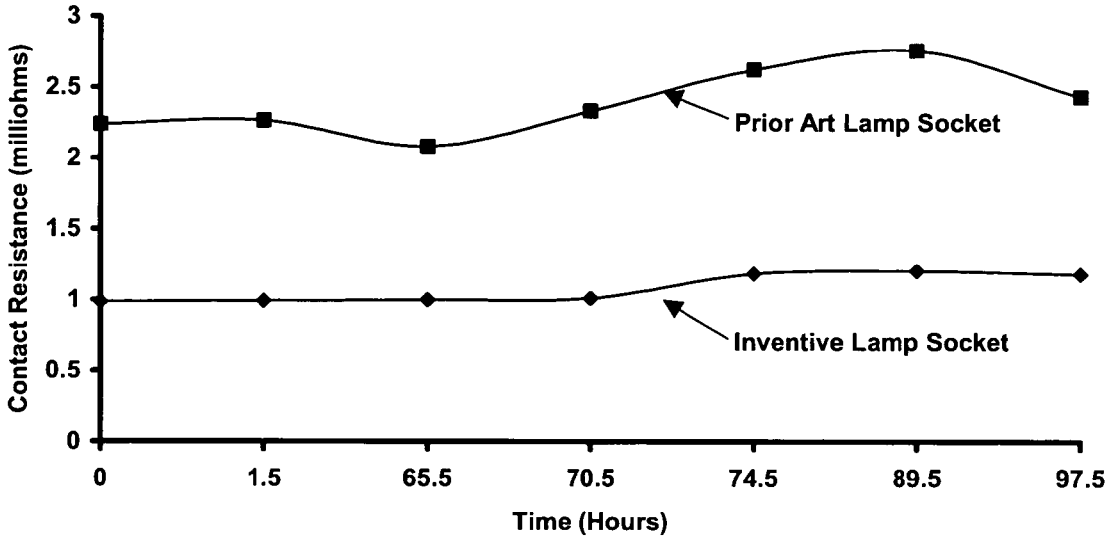
FIG. 4 is a graphical representation comparing the contact resistance of a lamp socket of this invention versus that of a prior art lamp socket as a function of operating time.
Figure 5:
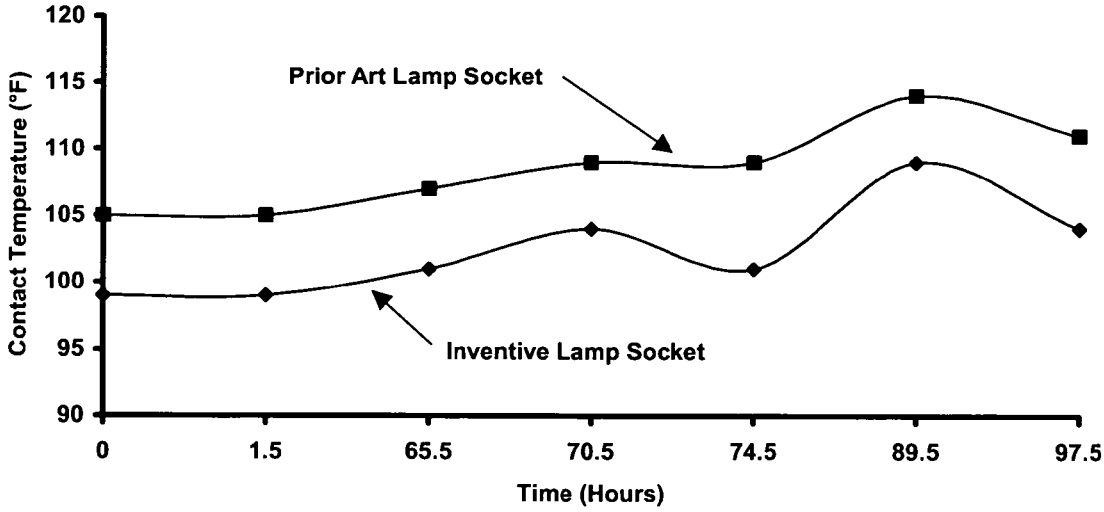
FIG. 5 is a graphical representation comparing the contact temperature of a lamp socket of this invention versus that of a prior art lamp socket as a function of operating time.

FIGS. 4 and 5 are graphs comparing the contact resistance and contact temperature of the lamp socket of this invention versus a prior art socket similar to the one described in German Gebrauchmuster No. 295 04 517. The data was obtained by operating identical lamps in the lamp sockets which were not installed in fixtures. The data is shown as a function of operating time. The advantages of lower contact resistance and lower contact temperature for the lamp socket of this invention are evident.

While there have been shown and described what are present considered to be the preferred embodiments of the invention, it will be apparent to those skilled in the art that various changes and modifications can be made herein without departing from the scope of the invention as defined by the appended claims.

What is claimed is:

1. A connector for a lamp comprising:

a ceramic housing having a top surface and a bottom surface and including a contact receiving area formed in said top surface;

an electrical contact positioned in said contact receiving area, said electrical contact having a rectangular base with two sides and two ends;

opposed, upright walls extending from the sides of said base, and an upright clip extending from an end of said base, said upright walls and said upright clip having portions projecting beyond said top surface of said ceramic housing to receive an end of a lamp therein; and the electrical contact being mounted within a supplemental spring, the supplemental spring having opposed legs disposed adjacent to the upright walls of the contact, the legs of the supplemental spring engaging said upright walls when the lamp is inserted into the electrical contact.

2. The connector of claim 1 wherein said opposed, upright walls have curved terminal ends to receive said end of said lamp.

3. The connector of claim 2 wherein said opposed, upright walls are resilient so as to frictionally engage said end of said lamp.

4. The connector of claim 3 wherein said upright clip has its terminal end horseshoe-shaped to engage a second zone of said end of said lamp.

5. The connector of claim 1 wherein said supplemental spring is substantially U-shaped with a bight positioned beneath said rectangular base of said electrical contact.

6. A connector for a lamp comprising:

a ceramic housing having a top surface and a bottom surface and including a contact receiving area formed in said top surface;

an electrical contact positioned in said contact receiving area said electrical contact having a rectangular base with two sides and two ends;

opposed, upright walls extending from the sides of said base, and an upright clip extending from an end of said base, said upright walls and said upright clip having portions projecting beyond said top surface of said ceramic housing to receive an end of a lamp therein, said upright clip being provided with a wire connector, said wire connector comprising a metal block having two orthogonal apertures therethrough, a first of said apertures receiving a means to mount said wire connector to said clip and the second of said apertures being formed to receive a wire from a power supply; and the electrical contact being mounted within a supplemental spring, the supplemental spring having opposed legs disposed adjacent to the upright walls of the contact, said supplemental spring being substantially U-shaped with a bight positioned beneath said rectangular base of said electrical contact.

7. The connector of claim 5 wherein the opposed legs of the supplemental spring are notched in a region adjacent to the bight.

8. A connector for a lamp comprising:

a ceramic housing having a top surface and a bottom surface and including a contact receiving area formed in said top surface;

an electrical contact positioned in said contact receiving area, said electrical contact having a rectangular base with two sides and two ends;

opposed, upright walls extending from the sides of said base, and an upright clip extending from an end of said base, said upright walls and said upright clip having portions projecting beyond said top surface of said ceramic housing to receive an end of a lamp therein, said opposed, upright walls being resilient so as to frictionally engage said end of said lamp and having curved terminal ends to receive said end of said lamp; and the electrical contact being mounted within a supplemental spring, the supplemental spring being substantially U-shaped and having opposed legs disposed adjacent to the upright walls of the contact, the legs of the supplemental spring engaging said upright walls when the lamp is inserted into the electrical contact.

9. The connector of claim 8 wherein said upright clip is provided with a wire connector, said wire connector comprising a metal block having two orthogonal apertures therethrough, a first of said apertures receiving a means to mount said wire connector to said clip and the second of said apertures being formed to receive a wire from a power supply.

10. The connector of claim 8 wherein the supplemental spring has a bight positioned beneath said rectangular base of said electrical contact and the opposed legs are notched in a region adjacent to the bight.

11. A socket for a double-ended lamp comprising:

two opposed connectors, each in accordance with claim 1, said two connectors being separated by a given distance and being attached to a connecting bar.

* * * * *